United States Patent [19]

Petersen et al.

[11] Patent Number: 4,515,555

[45] Date of Patent: May 7, 1985

[54] VAPOR BURNER FOR LIQUID FUEL

[75] Inventors: Jorgen H. Petersen; Peter J. M. Clausen; Hilmar Ø. Rasmussen, all of Nordborg, Denmark

[73] Assignee: Danfoss A/S, Nordborg, Denmark

[21] Appl. No.: 545,528

[22] Filed: Oct. 26, 1983

[30] Foreign Application Priority Data

Nov. 24, 1982 [DE] Fed. Rep. of Germany ..... 3243396

[51] Int. Cl.[3] ..... F23D 11/44

[52] U.S. Cl. ..... 431/208

[58] Field of Search ..... 431/208

[56] References Cited

U.S. PATENT DOCUMENTS

| | | | |
|---|---|---|---|
| 2,707,989 | 5/1955 | Schori | 431/208 |
| 3,190,071 | 6/1965 | Negre | 431/208 |
| 4,396,372 | 8/1983 | Matomoto et al. | 431/208 |
| 4,408,984 | 10/1983 | Forster | 431/208 |

FOREIGN PATENT DOCUMENTS

| | | | |
|---|---|---|---|
| 295827 | 3/1954 | Switzerland | 431/208 |

*Primary Examiner*—Carroll B. Dority, Jr.
*Attorney, Agent, or Firm*—Wayne B. Easton

[57] ABSTRACT

The invention relates to a vapor burner for liquid fuel having an elongated gasifying chamber preceeding a combustion chamber which is heatable to gasifying temperatures by electrical heating apparatus. The gasifying chamber has an inlet for liquid fuel and an outlet for the gasified fuel feeding into the combustion chamber. The gasifying chamber is formed so that no forced air is admissible to the inlet thereof. The heating apparatus heats the gasifying chamber along the length thereof and includes apparatus surrounding the outlet end thereof to form a glow zone heatable to the fuel mixture ignition temperature.

31 Claims, 6 Drawing Figures

VAPOR BURNER FOR LIQUID FUEL

Figure 1:
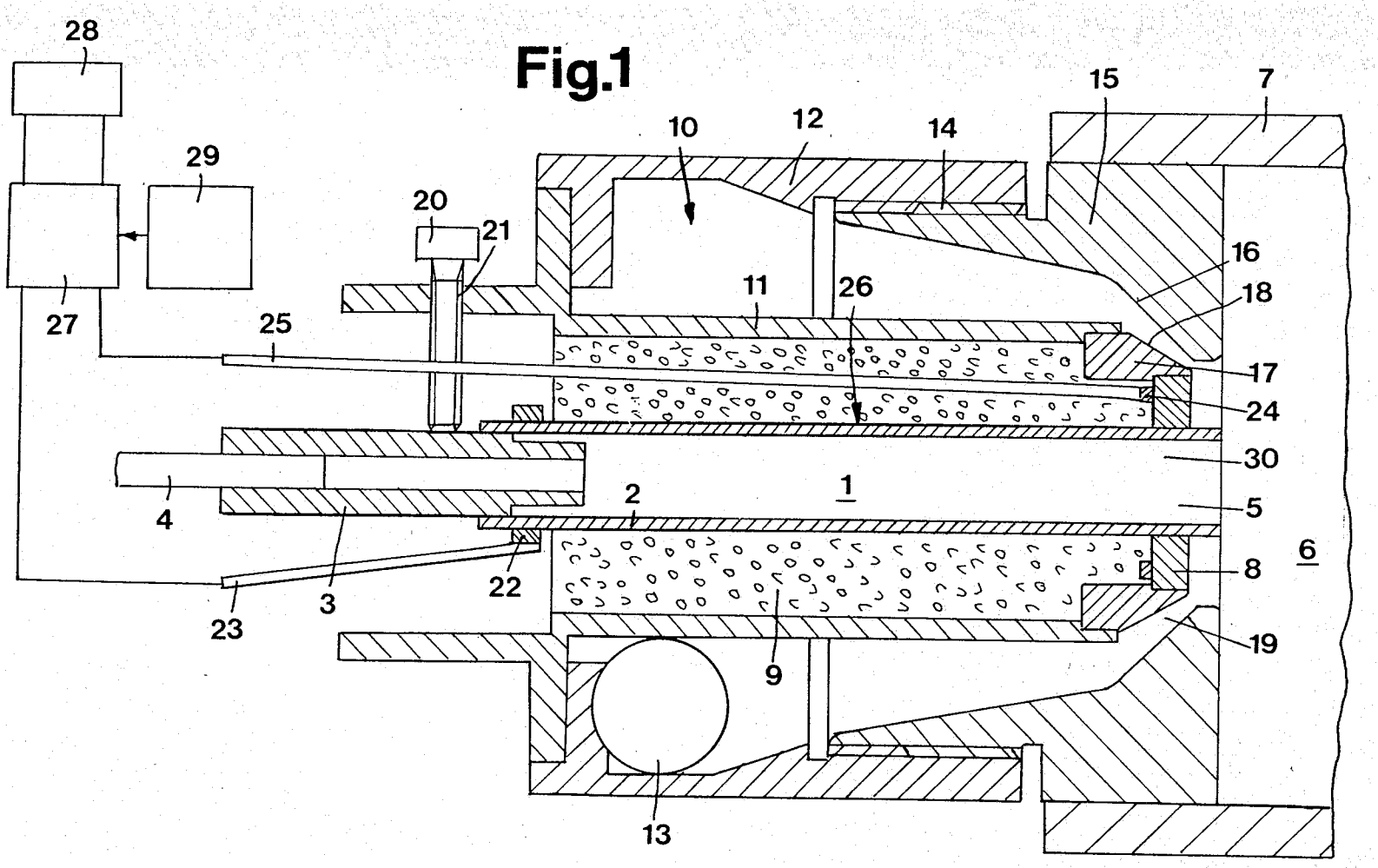

The invention relates to a vapour burner for liquid fuel comprising a gasifying chamber which is heatable to gasifying temperature by an electric heating apparatus and possibly by recirculating hot gases and has an inlet for the liquid fuel and an outlet for the substantially gasified fuel for feeding into a combustion chamber, a passage system for supplying at least the predominant part of the air of combustion to the combustion chamber, and an electric ignition apparatus.

In a known vapour burner of this kind (VDI-Reports No. 423, 1981, pages 175 to 180), the vapour chamber consists of a multiplicity of parallel passages of small cross-section accommodated in a hollow cylindrical body and surrounded by a heating coil. Liquid fuel heated thereby leaves as a gas at the periphery of the hollow cylinder at an annular gap by way of which the air of combustion is supplied. Upon starting, the ignitable mixture thus formed is ignited by means of a high voltage spark produced by means of an ignition apparatus likewise disposed in the annular gap. The flame thus formed in the combustion chamber produces an internal annular eddy so that part of the flame gases flows through the interior of the hollow cylinder and is mixed on the other side with the entering air of combustion. By reason of this heating of the hollow cylinder, the electric heater can be entirely or partially switched off after starting.

With the aid of such a vapour burner, fuel can during normal operation be burnt with a blue or transparent flame but not stoichiometrically. The required excess air amounts to about 45% at a power of 12 KW. Upon starting, a yellow flame indicating incomplete combustion is unavoidable, as is the formation of soot. This is because the high voltage spark initially ignites the fuel gas-air mixture only at a small zone whereas the gaseous fuel leaving over the entire periphery is not burnt but can precipitate at cold portions of the combustion chamber.

The invention is based on the problem of providing a vapour burner of the aforementioned kind in which the starting process can take place with a blue flame and without soot formation.

This problem is solved according to the invention in that at least the outlet zone of the gasifying chamber is associated with a glow zone which is heatable to ignition temperature by the heating apparatus. When, on switching the burner on, the first drop of fuel reaches the gasifying chamber, it is vaporised and mixes with the air already contained in the chamber. The ignitable fuel gas-air mixture thus formed is ignited by the glow zone. This igniting flame is pushed out of the gasifying chamber by the subsequently produced fuel gas. When this unburnt gas enters the combustion chamber, it is mixed with the air of combustion supplied through the passage system. This combustible mixture is ignited by the ignition flame. This starting process can take place stoichiometrically or with a lean mixture, i.e. with excess air and facilitates an absolutely clean start without the formation of soot and without unburnt hydrocarbons. The starting process itself is very gentle. It is carried out without pulsations, steplessly and smoothly from the very first drop up to the set capacity which is adjustable within wide limits. It is particularly favourable if the glow zone can be produced with the aid of the electric heating apparatus that is in any case provided, i.e. if the energy supplied thereto can be utilised for gasification instead of being lost. This novel glow ignition also achieves considerable saving in costs because an ignition transformer, ignition cable, ignition electrodes and associated relays can be dispensed with. Further, there are no problems with ignition interference for radio and television receivers.

It is particularly advantageous if the gasifying chamber is substantially formed by a tube which is disposed centrally of the passage system and is associated with the glow zone at least near its mouth. The volume of the tube dimensioned for normal operation is so large that the amount of air contained in it suffices for producing a stable flame to begin with. Since the entire fuel must likewise leave over the mouth region of the tube where the expelled ignition flame is located, rapid ignition of the following fuel gas will be ensured. The glow zone in such a tube can also be comparatively simply constructed. In addition, it is in this way possible to achieve a blue flame even during normal operation, not only with an excess of air but also without any excess air.

To enable the heat required to form the glow zone to be transmitted to the tube, it is desirably surrounded directly by the heating apparatus. It can lie directly on the tube or, if the latter is itself electrically conductive, with the interpositioning of an electrically insulating layer, e.g. a sleeve.

The heating apparatus, can, for example, be a sleeve provided with longitudinal slots that surrounds the tube and is provided with connections at the inlet end. As in the case of the previously mentioned insulating sleeve, this sleeve can consist of two segments. Other alternatives make provision for heating spirals or the like.

Another possiblity of producing a glow zone with the least possible power resides in making the tube of electric resistance material and itself serving at least as part of the heating apparatus.

The heating apparatus, whether it be the tube or an additional sleeve, preferably consists of silicon carbide. This provides an adequate electrical conductivity as well as useful thermal resistance. Such silicon carbide bodies can be made in one piece as a tube or in the form of two semi-tubular segments.

A tube consisting of silicon carbide should be saturated with silicon or carry a covering of silicon oxynitride to make the tube gas-tight. The covering is also electrically insulating.

There are many ways of producing the glow zone. For example, the glow zone may be formed by a wall region of smaller cross-section. With otherwise uniform heating, a thinner wall or a wall provided with recesses will then assume a higher temperature than the remainder of the wall.

The glow zone can also be formed by a wall region which is associated on the outside with a sleeve member which increasingly reduces the dissipation of heat. The build-up of heat likewise results in a higher surface temperature.

For example, the sleeve member may be a ring which is itself heated. By reason of the temperature increase, the dissipation of heat in the enveloped wall region is lower than if the ring temperature were only slightly increased. The ring may be heated either by a separate heating resistor or by the current flowing therethrough.

To form the glow zone, a separate tube section may also be provided which forms or surrounds the outlet region of the gasifying chamber. This tube section may be specially selected for the glowing step.

Another possibility for the purpose of forming the glow zone is for the heating apparatus to have a section with more intensive power output. If the heating coil consists of a winding, the individual convolutions will be more closely juxtaposed in the said section. The heating apparatus can also comprise two heating members, one of which is associated with the glow zone and the other with the remainder of the tube. This facilitates switching off of the glow zone heating member during operation. The heating member associated with the rest of the tube may be a PTC resistor which ensures an adequate gasifying temperature but avoids overheating.

It is also favourable if the heating apparatus can be switched over to at least two power stages of which one serves to produce the glow temperature in the glow zone and the other to produce the lower gasifying temperature. The power for the glow temperature need therefore be supplied only during starting.

It is often advisable to have a regulating apparatus which steplessly regulates the heating power as a function of the nature and amount of the fuel that is supplied. The heating energy can therefore be kept small but nevertheless ensure adequate gasfication. In a preferred embodiment, the gasifying chamber is heatable by the heating apparatus in the absence of a fuel supply to a cleansing temperature which is adequate for burning deposits to ash, its at least one outlet aperture having a cross-section of at least 1 $mm^2$, preferably more than 3 $mm^2$. By utilising the heating apparatus that is in any case provided, one can thereby make provision for a cleansing phase to clean the walls of the gasifying chamber of deposits, so that the transmission of heat for gasification and glow ignition will always be an optimum. The outlet apertures are sufficiently large to blow the ash out of the gasifying chamber. Blowing out can, for example, be effected automatically during to next switching-on phase because the volume of the supplied liquid fuel increases approximately twentyfold during gasification.

To enable adequately high cleansing temperatures to be employed, the material of the gasifying chamber should have a temperature resistance of at least 700° C., preferably up to about 1400° C., and for short periods up to 2000°.

It is also favourable for the gasifying chamber to have a supply for secondary air near the inlet and/or between the gasifying zone and the glow zone. The supply may exhibit such large flow resistances that the amount of secondary air is less than 1.9% and preferably from 0.2 to 0.5% of the entire air of combustion. This makes ignition more certain because the supplied air increases the igniting flame as well as the duration of its existence before it is extinguished by the next following fuel gas. The secondary air acts as a kind of carrier gas especially in the case of low power, whereby an adequate speed of gas can be maintained in the mouth of the tube. The self-cleaning effect is also increased because more oxygen is available for separating the deposit and the ash is continuously blown out. The amount of air can be so small that it has no influence on the power required for gasification.

The outlet end of the tube is preferably provided with an end plate to reduce the outlet cross-section. The outlet cross-section is formed by apertures in the end plate and/or adjoining parts of the tube. This reduction in the outlet cross-section on the one hand leads to suppression of the initial ignition flame and on the other hand to the formation of a protective zone on the outside of the end plate, in which the flame can be maintained for longer periods. The end plate has the further advantage of compelling drops of fuel that has not yet completely evaporated to remain in the gasifying tube for a longer period.

An advantageous end plate is, for example, one having a central hole with a cross-section of 5 to 40% of the internal tube cross-section.

In an alternative, the outlet end of the tube is provided with an outer ring, the tube projects axially beyond the ring and the projecting portion is provided with outlet apertures at the circumference. This flange likewise forms a protective zone at which the initially formed flame leaving through the circumferential apertures can be well maintained. This type of outlet aperture has the additional advantage that the discharged gaseous fuel can readily mix even during normal operation with the air of combustion supplied from the concentric passage system.

In another embodiment, a projecting ring is provided on the outlet side of the tube and has a diverging internal cone. Such a ring with an annular projection provides particularly good guiding for the initially formed flame and for the subsequent jet of gasified fuel.

With particular advantage, the glow zone is formed on the projecting ring. The fuel-air mixture that is first formed on starting is therefore ignited over the entire circumference as it leaves and provides a very stable ignition flame.

It is also recommended for the apex angle of the internal cone to be larger than the apex angle of the gaseous fuel jet leaving the tube. In that event, recirculation is obtained between the gas jet and internal cone with the result that the glow zone can continuously ignite an ignitable mixture.

The projecting ring may consist of electric resistance material and itself form part of the heating apparatus. In this way, the glow zone can be produced with little energy. Further, the projecting ring may be surrounded on the outside by a guide cone of thermally insulating material along which the air of combustion is supplied. This insulating guide cone prevents excessive cooling of the projecting ring. In addition, it facilitates the supply of air of combustion in a very accurately predetermined pattern.

Further, the tube can be provided at the outlet end with an outer ring which is thermally conductively connected to the tube and the end face of which confronts the combustion chamber. This ring is heated by the flame in the combustion chamber and transfers heat to the tube. Consequently, the electric heating apparatus can be entirely or partially switched off after normal operation has been attained. Air passages for the supply of air of combustion may also pass through the ring. In particular, throttled air jets can be directed to the places where the fuel gas leaves the tube. If there is a danger of the flame thermally stressing the vapour burner too intensively, the outlet end of the tube may be provided with an external ring of thermally insulating material.

In another modification, the tube has at least one planar face against which a plate-shaped heating member abuts. In particular, the tube has a substantially rectangular cross-section and at least two plate-shaped heating members lie against the sides of the rectangle. They can be pressed against the planar faces of the tube to produce good thermal transfer.

Further, the tube may have an oval cross-section and the heating apparatus consist of two semi-oval sleeve segments. This facilitates assembly.

In a further embodiment, the tube is concentrically surrounded by an electrically conductive cover which is electrically connected thereto and two electric terminals are provided at the inlet end of the tube and of the cover. In this way, it is possible for the tube to be heated up to the foremost end and in particular to provide a glow zone at the foremost end. The terminals, on the other hand, lie in the zone having the lowest temperature.

The annular gap between the tube and cover may serve as an air passage connected by an aperture in the cover at the outlet end of the tube and of the gasifying chamber. The secondary air supplied in small quantities is therefore preheated. Gasification is therefore not detrimentally influenced by the entering air.

Further, supply lines for tertiary air may be provided in the region of the outlet apertures of the gasifying chambers. This tertiary air improves the formation of the flame.

Preferred examples of the invention will now be described in more detail with reference to the drawing.

FIGS. 1 to 6 illustrate cross-sections or part-sections of six different embodiments of a vapour burner according to the invention.

A gasifying chamber 1 is formed substantially by an oval or cylindrical tube 2. At the inlet side, a holder 3 is inserted and secured in a gas-tight manner. Hermetically sealed thereto, there is a supply line 4 for the liquid fuel. On the outlet side there is a mouth or outlet aperture 5 which faces a combustion chamber 6 bounded by a combustion tube 7. A ring 8 is placed over the front end of tube 2. The remainder of the tube is surrounded by thermal insulation 9.

A passage system 10 serves to supply air of combustion to the combustion chamber 6. It is bounded on the inside by a housing 11 which surrounds the thermal insulation 9 and on the outside by a cover 12 with a tangential connection 13 and an insert 15 connected thereto by a screwthread 14. The insert has a conical guide face 16. Between the ring 8 and housing 11 there is a guide ring 17 with a conical face 18 which, together with the conical face 16, forms a conical annular gap 19 for discharge of the air of combustion. The size of this annular gap can be set by turning the insert 15. A screw 20 which engages through a screwthread 21 in the housing 11 fixes the holder 3 and thus the tube 2 together with two other screws (not shown).

In this example, the tube 2 and ring 8 consist of electrically conductive material, namely silicon carbide which has been hermetically sealed by saturation with silicon or by means of a covering of silicon oxynitride. An annular connection 22 at the rear end of tube 2 is connected to a conduit 23 and an annular connection 24 at the outer end of ring 8 is connected to a supply conduit 25. The heating apparatus 26 thus formed is actuated by way of a regulating and switching apparatus 27 which is energised by a voltage source 28, for example the mains voltage, and is controlled by an automatic firing device 29 which, in known manner, receives signals from boiler thermostats, a flame monitor and the like and, when necessary, automatically switches the burner off. Upon the supply of current, the tube 2 assumes a temperature above the gasifying temperature of the liquid fuel. By reasson of the poorer dissipation of heat near the ring 8, a glow zone 30 is formed at this location at which the tube material assumes a glow temperature.

The thermal insulation 9 can, for example, consist of ceramic fibres, aluminium oxide, silicon dioxide and the like. The guide ring 17 should be of electrically and thermally insulating material so that the ring 8 will not be excessively cooled by the air of combustion.

To start the burner, the heating apparatus 26 is first switched on. As soon as the required temperature has been reached, the supply of fuel is switched on. The first drop reaching the gasifying chamber 1 vaporises and forms an ignitable mixture together with the air located within the tube 2, this mixture being ignited in the flow zone 30 and thereby forming an ignition flame. This ignition flame is pushed into the combustion chamber 6 by the following gaseous fuel which, together with the air of combustion supplied for the passage system 10, itself forms a combustible mixture which is ignited by the ignition flame already present. Such ignition of the next following combustible gas mixture is continued until a stable flame front has been formed. This starting procedure can take place with a lean mixture, i.e. with excess air, as well as stoichiometrically and provides an absolutely clean start, i.e. without soot formation or unburnt hydrocarbons. Further, starting takes place steplessly without pulsations from the very first drops up to the set capacity. This gentle start applies to all values of capacity within a large power range.

Since the ring 8 is heated by the flame jet in the combustion chamber 9 and the tube 2 therefore receives heat, the electrical energy can be reduced during operation.

When switching off, the supply of fuel is simply interrupted. If the heating current is interrupted with a slight time delay, the fuel that is still being supplied can be gasified with certainty so that soot-free switching off is possible with continued operation of the burner fan.

In addition, a cleansing phase can be provided at definite time intervals, during which no fuel is supplied but the heating apparatus 26 is heated to a temperature such that deposits adhering to the wall are burnt to ash which is then blown out through the mouth 5 by the gaseous fuel during the following switching-on phase.

Figure 2:
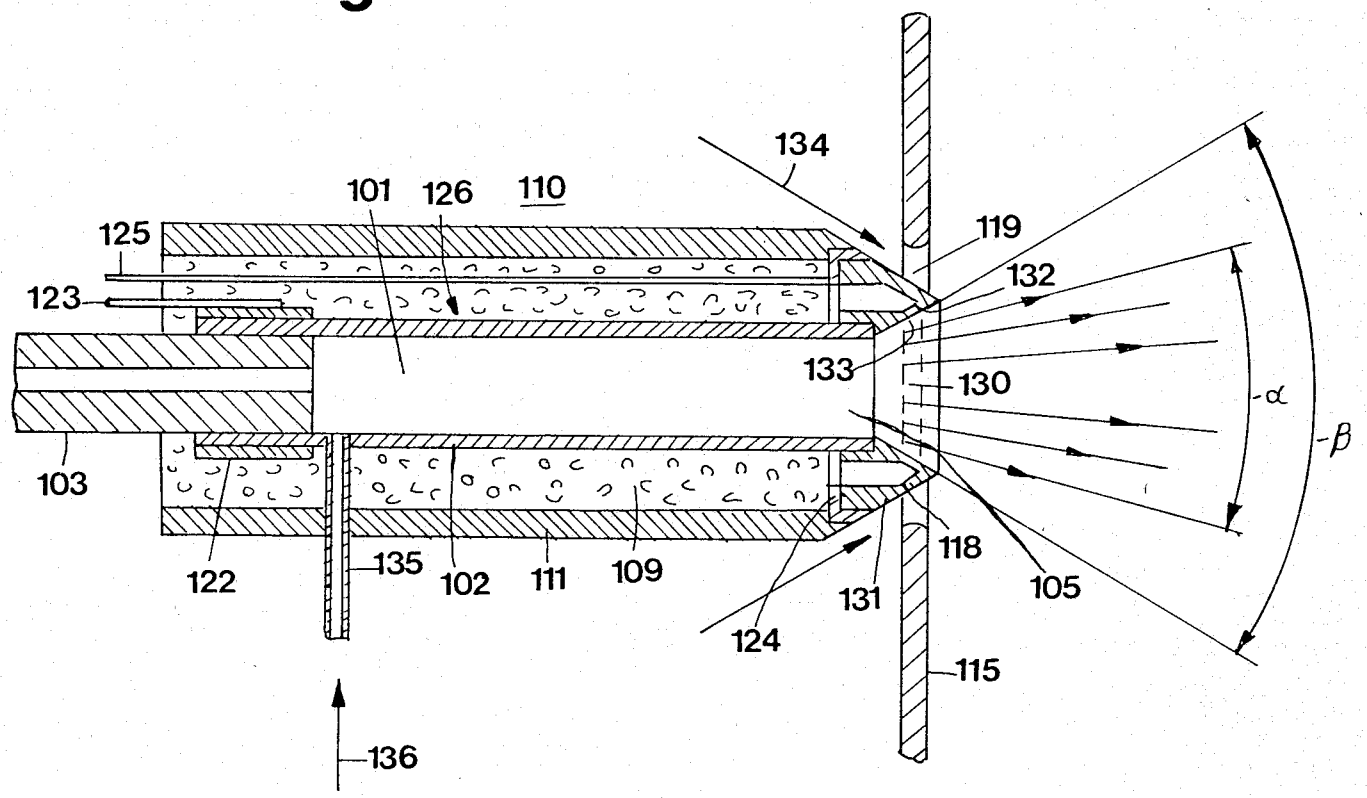

In the FIG. 2 embodiment, reference numerals increased by 100 are used for parts corresponding to those in FIG. 1. What is different is that the insert 15 is replaced by a wall 115. Another difference is that a projecting ring 131 provided at the mouth 105 of tube 102 has an inner conical face 132. Its apex angle $\beta$ is somewhat larger than the apex angle $\alpha$ of the leaving jet of gaseous fuel. In addition, this conical face 132 is partially formed by a comparatively thin wall 133 which, upon current flow, readily commences to glow and thus form the glow zone 130. By reason of the difference in the two apex angles, there is recirculation to the glow zone, by which the ignition behaviour can be improved. An external conical face 118 of the projecting ring 131 corresponds to the conical face 18 of the guide member 17 in FIG. 1. The arrows 134 indicate that practically the entire air of combustion passes through the annular gap 119 into the combustion chamber. Over an air passage 135 communicating with the inlet end of the gasifying chamber 101, a small amount of secondary air passes as is indicated by the arrow 136. This amount should be no more than 1.9% of the maximum amount of the air of combustion. It facilitates formation of the flame at low burner powers and the combustion of deposits during the cleansing phase. The projecting ring 131 could also have different shapes if flow conditions demand same. In particular, it may be employed in conjunction with an apertured plate.

Figure 3:
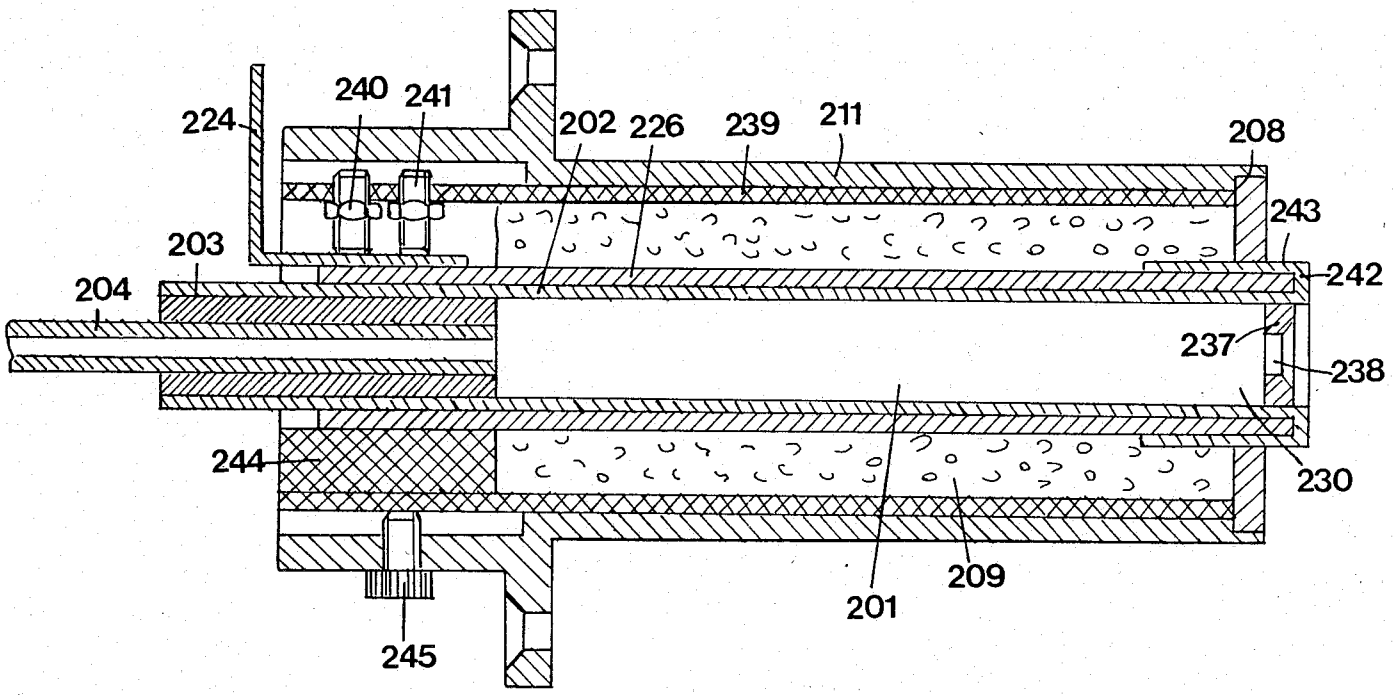

In the embodiment of FIG. 3, reference numerals increased by 200 are employed for integers corresponding to those in FIG. 1. In this case, the outlet end of tube 202 is provided with an end plate 237 having a central hole 238. Its cross-sectional area is between 5 and 40% of the internal cross-section of the gasifying chamber 201. The heating apparatus 226 is pushed over the outside of tube 202. It consists in this case of a segmented sleeve which is slotted several times from opposite sides by slots which do not extend right through. A higher resistance is present at the ends and thus a higher power is delivered at these ends to provide a glow zone in the region of the mouth of the tube. An insulating sleeve 239 between the housing 211 and thermal insulation 209 supports two screws 240 and 241 which press angular connections (only the connection 224 is illustrated) against the tube of the heating apparatus 226. To protect the burner end of the heating apparatus 226, the tube 202 is provided with a flange 242 and an adjoining sleeve 243. These parts ensure that the heating apparatus will not be short-circuited by coke deposits. Further, there is a spacer sleeve 244 having recesses in the region of the screws 240 and 241 and adapted to be clamped by a screw 245 to hold the tube 202 securely.

Figure 4:
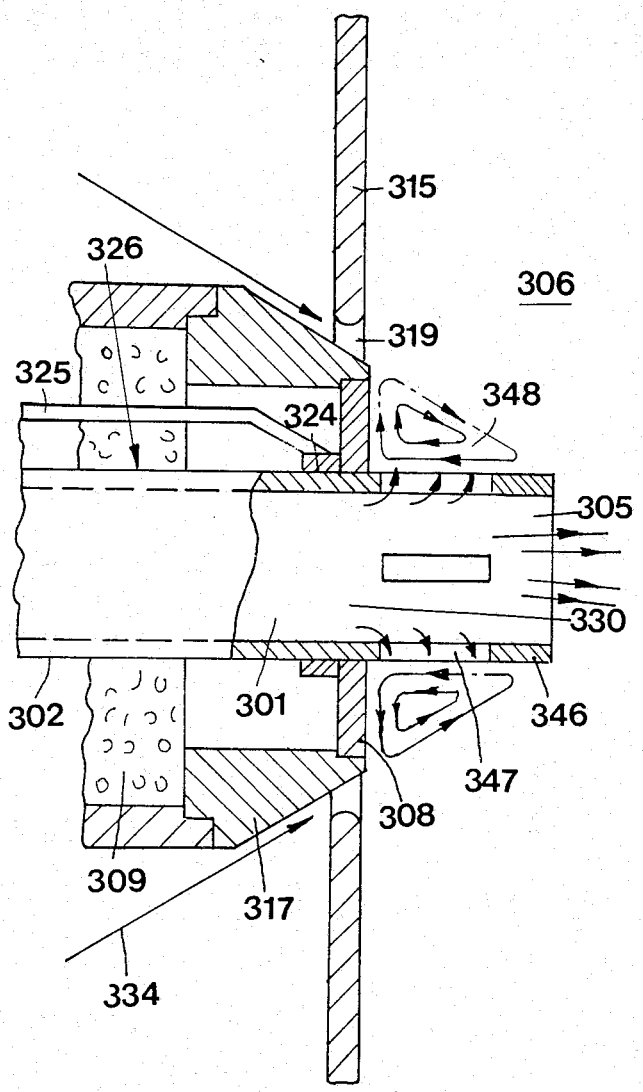

The FIG. 4 embodiment has corresponding parts with reference numerals increased by a further 100. These corresponding parts are illustrated as a gasifying chamber 301, outlet aperture 305 for the chamber, thermal insulation 309, surrounding tube 302, a divider plate 315 for setting the gap 319, an air flow guide ring 317, a fuel supply conduit 325, heating apparatus 326 for the tube 302 and a glow zone 330. This embodiment also includes a connection 324 directly on the tube 302. The front end 346 of tube 302 projects beyond the ring 308 into the combustion chamber 306 and is additionally provided with outlet apertures 347 at the circumference. The first flame leaving therethrough is protected by the outer ring 308 from the air of combustion 334 supplied as a rotating conical jet. An annular eddy 348 occurring in this zone produces a safe mixture of the air of combustion and of the fuel gasified as this position.

Figure 5:
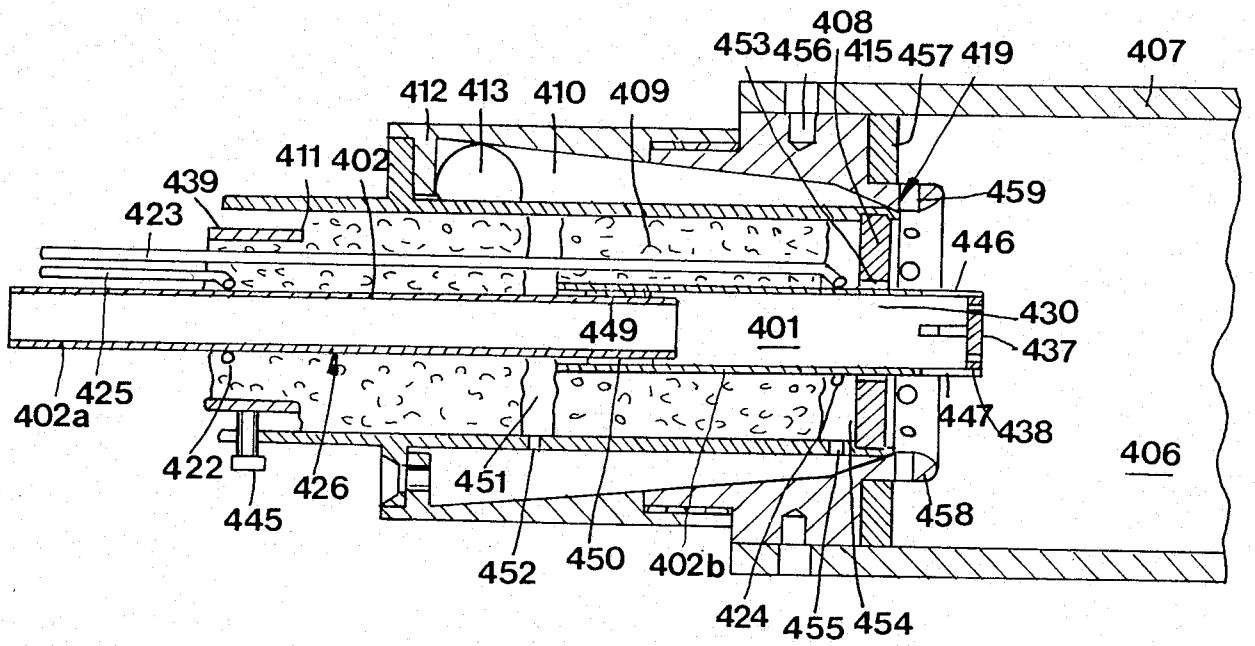

In the FIG. 5 embodiment, reference numerals again increased by 100 are employed for corresponding parts. The gasifying chamber 401 is formed by a tube 402 consisting of two parts 402*a* and 402*b* inserted in each other. Between these there is a supporting ring 449 having one or more longitudinal passages 450. On the inlet side, this passage is connected to the passage system 410 by a free space 451 and a bore 452 so that secondary air of combustion can be intrdocued in the tube 402 over this path. At the inner circumference, the ring 408 comprises grooves 453 which, by way of a free space 454 and a bore 455, likewise communicate with the passage system 10. Tertiary air of combustion can therefore be introduced to the combustion chamber through these grooves 453.

The end plate 437 has a plurality of holes 438 on a circle. Part of the first flame passes out of the end plate 437 through the apertures 438. At this position, the flame is well protected from the entering air of combustion. In addition, circumferential apertures 447 are provided in the projecting tube portion 446. Plug holes 456 permit turning of the insert 415 for the manual or automatic adjustment of the annular gap 419. A thermally insulating annular disc 457 protects the combustion chamber 406 from undesired cooling by the air of combustion in the passage system 410. In addition, a ring 458 with radial bores 459 is provided at the insert 415 for leading recirculating gases therethrough.

Figure 6:
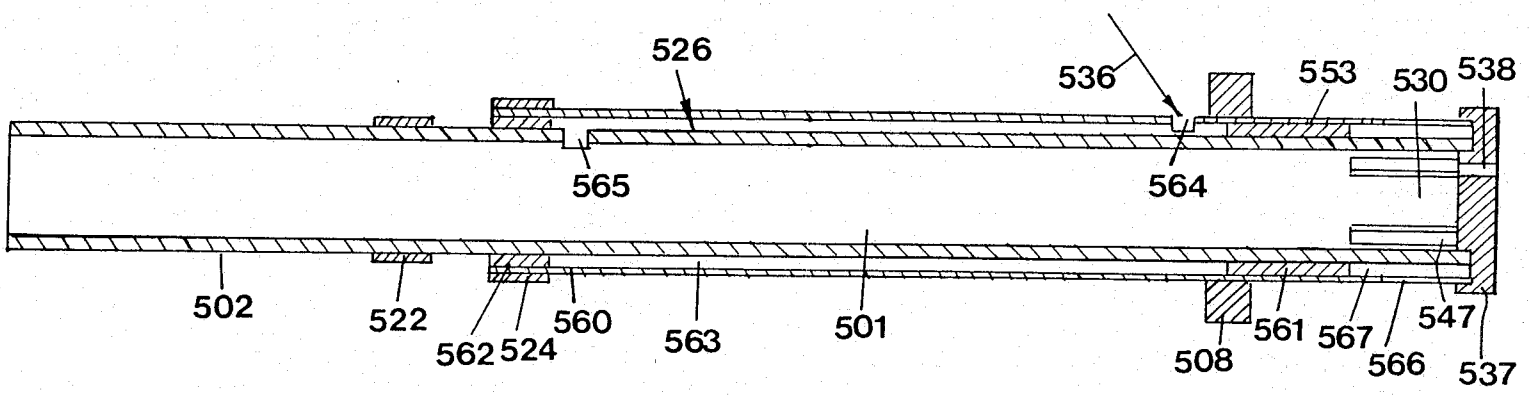

In the FIG. 6 embodiment corresponding parts have reference numerals increased by a further 100. These corresponding parts are illustrated as a gasifying chamber 501 formed by a cylindrical tube 502, a conductor ring 508 which surrounds the cylindrical cover which forms the air passage 563, an annular electrical connector 522 and 524 surrounding the tube 502 and the cylindrical cover 560, respectively, the heating apparatus 526 for the tube 502, the glow zone 530, the arrow 536 which indicates secondary air flow, and circumferential slots 547 in the tube 502 for admitting the secondary air to the gasifying chamber 501. This embodiment also includes a cover 560 concentrically surrounds the tube 502 and is likewise of electrically conductive material, e.g. silicon carbide with silicon and increased resistance in the front zone. The space between the tube and cover is ensured by a front electrically insulating supporting ring 561 and a rear electrically insulating supporting ring 562. The remaining gap 563 serves as an air passage. For this purpose, the cover 560 is provided with a front aperture 564 through which secondary air 536 is supplied from the passage system whilst a rear aperture 565 establishes communication with the gasifying chamber 501. In this way, the secondary air is heated before it makes contact with the fuel gas. In the front region, the cover 560 has circumferential apertures 566 which are angularly offset from the circumferential apertures 547 of tube 502. The annular space 567 therebetween can be provided with tertiary air of combustion through passages 553 in the supporting ring 561.

An end plate 537 has a plurality of holes 538 on a circle. End plates 537 has the same function in the FIG. 6 embodiment as the plate 437 has in the FIG. 5 embodiment.

On the whole, such a vapour burner brings a number of advantages. First, starting can be very gentle with a blue flame and without the formation of soot or unburnt hydrocarbons. The lower power limit at which stoichiometric combustion is possible is practically zero; in any case the lower limit of capacity is far lower than the value required for very small heat exchangers. By means of appropriate constructional dimensioning, there is practically no limit for the maximum capacity. The viscosity and density or surface tension of the fuel are immaterial. The range of fuel goes from very viscous oil up to gas. The vapour burner is insensitive to dirt because all the apertures are so large that no dirt particles can adhere and because deposits can be removed by automatic self-cleaning. The heating resistor can be designed for connecting to the mains or to a low voltage. An ignition transformer is not necessary. The feeding pressure for the fuel is very low. A pressure of 0.1 to 0.5 bar will suffice. The fuel can be gasified to such an extent that the theoretically lowest amount of excess air may be employed over the entire capacity range. In a burner of predetermined dimensions, the power can be regulated over a range of more than 1:10. Consequently, the fired amount of fuel can be adapted to the consumption by modulated operation. It is also possible to offer a single type for different capacities and different fuels, which simplifies production and the keeping of stock.

We claim:

1. A vapor burner for a liquid fuel, comprising, an elongated fuel gasifying chamber, a combustion chamber connected to said gasifying chamber, said fuel gasifying chamber having an inlet for liquid fuel and an outlet through which ignited gasified fuel is fed to said combustion chamber, said fuel gasifying chamber being formed so that no forced air is admissible thereto through said inlet end thereof, electrical heating means for heating said gasifying chamber to a gasifying temperature, air passage system means for supplying air of combustion to said combustion chamber, heating means surrounding the outlet end of said fuel gasifying chamber to form a glow zone heatable to the fuel mixture ignition temperature by said heating means.

2. A vapour burner according to claim 1 wherein said gasifying chamber is a tube arranged centrally of said air passage system, said glow zone being near the outlet mouth of said gasifying chamber.

3. A vapour burner according to claim 2 wherein said tube is surrounded by said electrical heating means.

4. A vapour burner according to claim 3 wherein said electrical heating apparatus includes a sleeve which surrounds said tube and at its inlet end has electrical connectors.

5. A vapour burner according to claim 3 wherein said tube is of an electric resistance material and itself serves at least as a part of said electrical heating means.

6. A vapour burner according to claim 1 wherein said electrical heating means is of silicon carbide.

7. A vapour burner according to claim 5 wherein said tube is of silicon carbide saturated with silicon.

8. A vapour burner according to claim 5 wherein said tube is of silicon carbide and carries a coating of silicon oxynitride.

9. A vapour burner according to claim 5 wherein said tube and said electrical heating means are surrounded by thermal insulation.

10. A vapour burner according to claim 2 wherein said gasifying chamber is formed by a cylindrical tube, a ring member at the outlet end of said tube for creating said glow zone, said ring member having a wall section of less wall thickness than the wall thickness of said cylindrical tube.

11. A vapour burner according to claim 1 wherein said glow zone is formed by a wall region and a sleeve member which strongly reduces the dissipation of heat.

12. A vapour burner according to claim 11 wherein said sleeve member is a ring which is itself heated.

13. A vapour burner according to claim 1 wherein tube means forms said fluid passage casing means and said tube means has glow zone and surrounding outlet zone of said gasifying chamber.

14. A vapour burner according to claim 2 wherein said electrical heating apparatus has a section giving a higher output to produce said glow zone.

15. A vapour burner according to claim 14 wherein said electrical heating means includes two heating members, one of said heating members being associated with said glow zone and the other with the remainder of said tube.

16. A vapour burner according to claim 1 wherein said gasifying chamber has a supply line for secondary air near the inlet thereof.

17. A vapour burner according to claim 1 wherein said gasifying chamber has a supply line for secondary air between the gasifying zone thereof and said glow zone.

18. A vapour burner according to claim 16 wherein said supply line exhibits such a high air flow resistance that the amount of secondary air is less than 1.9% of the total air of combustion.

19. A vapour burner according to claim 2 wherein an end plate is provided for the end of said tube adjacent said outlet thereof to reduce the cross section of said outlet.

20. A vapour burner according to claim 19 wherein said end plate has apertures.

21. A vapour burner according to claim 20 wherein said end plate has a central hole with a cross section of 5 to 10% of the internal cross section of said tube.

22. A vapour burner according to claim 2 wherein an outer ring is provided at the end of said tube adjacent said outlet thereof, said tube projecting axially through and beyond said ring to provide a projecting portion, and outlet apertures in the periphery of said projecting portion.

23. A vapour burner according to claim 2 having a projecting ring with a diverging internal cone at the outlet end of said tube.

24. A vapour burner according to claim 23 wherein said glow zone is formed on said projecting ring.

25. A vapour burner according to claim 23 wherein said projecting ring is of electric resistance material and itself forms part of said electrical heating means.

26. A vapour burner according to claim 2 including an outer ring surrounding said outlet side of said tube, said outer ring having thermal conductivity relative to said tube and having an end face which faces said combustion chamber.

27. A vapour burner according to claim 22 wherein said outer ring of thermally insulating material ahead of said projecting portion protects a flame leaving said outlet from combustion air.

28. A vapour burner according to claim 27 wherein said outer ring has air passages extending therethrough to supply air of combustion.

29. A vapour burner according to claim 2 including an electrically conductive cover surrounding said tube which is concentrically held at a spacing therefrom and electrically connected thereto at one end thereof, and two electric terminals connected to the inlet ends of said tube and said cover.

30. A vapour burner according to claim 29 wherein an annular gap formed between said tube and said cover serves as an air passage which is connected to said air passage system means by an aperture in said cover at the end of said tube adjacent to said outlet side thereof and to said gasifying chamber by an aperture at the end of said tube adjacent said inlet side thereof.

31. A vapour burner according to claim 22 wherein air passages for tertiary air are provided in said outer ring in the vicinity of said outlet apertures of said gasifying chamber.

* * * * *